US007841548B2

(12) United States Patent
Fecht et al.

(10) Patent No.: US 7,841,548 B2
(45) Date of Patent: Nov. 30, 2010

(54) HIGH PRESSURE NOZZLE AND METHOD FOR THE MANUFACTURE OF A HIGH PRESSURE NOZZLE

(75) Inventors: Albert Fecht, Riedrich (DE); Juergen Frick, Weinstadt-Endersbach (DE); Boris Schmidt, Esslingen (DE)

(73) Assignee: Lechler GmbH, Metzingen (DE)

( * ) Notice: Subject to any disclaimer, the term of this patent is extended or adjusted under 35 U.S.C. 154(b) by 0 days.

(21) Appl. No.: 12/152,362

(22) Filed: May 14, 2008

(65) Prior Publication Data

US 2008/0283635 A1 Nov. 20, 2008

(30) Foreign Application Priority Data

May 15, 2007 (DE) ..... 10 2007 024 247

(51) Int. Cl.
*B05B 1/14* (2006.01)
*B05B 1/00* (2006.01)

(52) U.S. Cl. ..... 239/590; 239/590.3; 239/597; 239/462; 239/591

(58) Field of Classification Search ..... 239/590, 239/590.3, 552, 565
See application file for complete search history.

(56) References Cited

U.S. PATENT DOCUMENTS

| | | | | | |
|---|---|---|---|---|---|
| 259,667 | A | * | 6/1882 | Churchman | 239/552 |
| 2,391,934 | A | * | 1/1946 | White | 239/552 |
| 3,052,574 | A | | 9/1962 | Kennedy, Jr. | |
| 3,062,455 | A | * | 11/1962 | Reip | 239/552 |
| 3,321,140 | A | * | 5/1967 | Parkison et al. | 239/428.5 |
| 3,362,648 | A | * | 1/1968 | Aghnides | 239/428.5 |
| 3,486,700 | A | * | 12/1969 | Bristow | 239/590.5 |
| 3,510,065 | A | * | 5/1970 | Gigantino et al. | 239/590 |
| 3,640,472 | A | * | 2/1972 | Hruby et al. | 239/552 |
| 4,142,456 | A | * | 3/1979 | Locker | 454/305 |
| 4,348,170 | A | * | 9/1982 | Vatsky et al. | 431/188 |
| 4,848,672 | A | * | 7/1989 | Matsumoto et al. | 239/590.5 |
| 5,119,863 | A | * | 6/1992 | Okesaku et al. | 139/435.4 |
| 5,169,065 | A | | 12/1992 | Bloch | |
| 5,316,470 | A | * | 5/1994 | Sigler | 431/286 |
| 5,333,841 | A | * | 8/1994 | Showalter et al. | 266/51 |
| 5,402,938 | A | * | 4/1995 | Sweeney | 239/431 |

(Continued)

FOREIGN PATENT DOCUMENTS

DE 1185566 1/1965

(Continued)

OTHER PUBLICATIONS

Examination Report of Germany Patent Office dated Oct. 26, 2007 (3 pages).

(Continued)

*Primary Examiner*—Len Tran
*Assistant Examiner*—James S Hogan
(74) *Attorney, Agent, or Firm*—Flynn, Thiel, Boutell & Tanis, P.C.

(57) ABSTRACT

High pressure nozzle and method for the manufacture of a high pressure nozzle. The high pressure nozzle has a jet director located within a supply channel leading to a discharge opening. In an area directly surrounding the supply channel median longitudinal axis, the jet director has a free flow cross-section.

15 Claims, 7 Drawing Sheets

U.S. PATENT DOCUMENTS

| | | | | |
|---|---|---|---|---|
| 5,878,966 | A | 3/1999 | Asakawa et al. | |
| 6,036,481 | A * | 3/2000 | Legutko et al. | 431/354 |
| 6,776,855 | B1 | 8/2004 | Ueda et al. | |
| 7,090,153 | B2 * | 8/2006 | King et al. | 239/553 |
| 7,134,345 | B2 | 11/2006 | Kaiser et al. | |
| 7,172,142 | B2 * | 2/2007 | Taylor et al. | 239/590 |
| 2003/0052199 | A1 | 3/2003 | Ikeuchi et al. | |
| 2005/0139008 | A1 | 6/2005 | Kaiser et al. | |
| 2005/0156064 | A1 | 7/2005 | Tanigaki et al. | |
| 2006/0255167 | A1 | 11/2006 | Vogel et al. | |

FOREIGN PATENT DOCUMENTS

| | | | |
|---|---|---|---|
| DE | 91 09 175.6 | | 11/1991 |
| DE | 297 06 863 | U1 | 7/1997 |
| DE | 29706863 | U1 * | 7/1997 |
| DE | 695 05 566 | T2 | 7/1999 |
| DE | 102 11 590 | A1 | 10/2003 |
| DE | 10361769 | | 7/2005 |
| EP | 0 792 692 | A1 | 9/1997 |
| EP | 1 184 108 | A2 | 3/2002 |
| EP | 1 293 258 | A1 | 3/2003 |
| JP | 8-296151 | | 11/1996 |
| JP | 2006-122834 | | 5/2006 |
| WO | WO 93/17820 | | 9/1993 |
| WO | WO 98/00214 | | 1/1998 |
| WO | WO 2004/004913 | A1 | 1/2004 |

OTHER PUBLICATIONS

European Patent Office Search Report dated Nov. 4, 2009 (6 pages).
European Patent Office Search Report dated Dec. 28, 2009 (19 pages).

* cited by examiner

HIGH PRESSURE NOZZLE AND METHOD FOR THE MANUFACTURE OF A HIGH PRESSURE NOZZLE

FIELD OF THE INVENTION

The invention relates to a high pressure nozzle with a jet director within a supply channel to a discharge opening. The invention also relates to a method for the manufacture of a high pressure nozzle.

BACKGROUND OF THE INVENTION

European patent EP 792 692 B1 discloses a high pressure nozzle for descaling steel products, which is provided with a jet director within a supply channel to a discharge opening. The jet director is formed in a cross-sectionally radial component and has a cylindrical central part from which extend radially flow guidance surfaces. To reduce the flow resistance of the jet director, in both the upstream and downstream directions the cylindrical central part is extended in the form of a conical tip. Upstream of the jet director is located a filter, which is formed from a tubular portion with a spherical cap-shaped termination and with radial grooves for the entry of liquid. The radial grooves extend into the spherical segmental cap of the filter. Downstream of the jet director there is a gradual tapering of the flow channel, which extends with decreasing taper angle to a discharge chamber in a mouthpiece. The mouthpiece has the discharge chamber and the discharge opening connecting onto said discharge chamber. As a result of the very high liquid pressures with which the high pressure nozzles are operated for descaling steel products and which can be several 100 to 600 bar, a low flow resistance is decisive, because pressure losses within the high pressure nozzle either lead to a lower removal or to the need for a higher pressure of the supply line. In addition, the shape of the flat jet or spray produced is decisive and for achieving an excellent removal action it should have a minimum width. Finally the high pressure nozzle is exposed to considerable mechanical stresses, because e.g. pressure surges in the supply line can lead to a collapse of the high pressure nozzle filter.

The invention aims to provide an improved high pressure nozzle.

According to the invention for this purpose is provided a high pressure nozzle, particularly for descaling steel products, which has a jet director within a supply channel to a discharge opening, in which in an area directly surrounding the median longitudinal axis of the supply channel the jet director has a free flow cross-section.

This leads to a so-called coreless jet director, which is characterized on the one hand by a low flow resistance and on the other by a very good orienting or straightening action. Thus, the jet director has a flow channel, without built-in fittings, directly surrounding the median longitudinal axis. Compared with conventional jet directors having a central, cylindrical component from which flow guidance surfaces emanate radially, the inventive jet director has a significantly reduced flow resistance, because the flow channel directly surrounding the median longitudinal axis of the supply channel remains free and can be used for an unhindered through-flow. As the free cross-section available for the flow is much larger, a significant flow resistance reduction is obtained. The free flow cross-section can e.g. have a radius amounting to approximately ⅕ of the internal radius of the jet director.

According to a further development of the invention the jet director has flow guidance surfaces extending parallel to and towards the median longitudinal axis of the supply channel.

By means of such flow guidance surfaces oriented parallel to the median longitudinal axis of the supply channel a good directivity of the jet director can be obtained and a flow which has traversed the jet director is oriented substantially fully parallel to the median longitudinal axis downstream of the jet director.

In a further development of the invention the flow guidance surfaces extend radially towards the median longitudinal axis.

This leads to planar, flow guidance surfaces having a very good orienting action with a low flow resistance.

In a further development of the invention a tapering of the supply channel takes place downstream of the jet director.

Such a tapering or narrowing concentrates the flow and over a short path the flow channel can be reduced to the cross-section of the discharge chamber. According to the invention there is a short taper and the tapering portion of the supply channel only has roughly half to a third of the jet director length.

In a further development of the invention, downstream of the jet director is connected to the taper a portion having a constant cross-section, which passes into a tapering discharge chamber.

By means of such a constant cross-section portion a flow calming can be brought about, which leads to a very good jet quality with a low flow resistance. The constant cross-section portion is advantageously longer than the taper downstream of the jet director. It has proved to be advantageous for the constant cross-section portion to be at least twice as long as the taper downstream of the jet director and in particular to make it seven times as long as the taper. The discharge chamber passes into the discharge opening from which emanates the spray jet.

In a further development of the invention upstream of the jet director is provided a filter having entrance slots oriented radially to the median longitudinal axis. Advantageously the entrance slots extend parallel to the median longitudinal axis. The filter can have a spherical segmental filter cap provided with entrance openings parallel to the median longitudinal axis.

The entrance openings in the spherical segmental filter cap are separated from the entrance slots, so that the spherical segmental filter cap can have a very stable construction and can in particular withstand any pressure surges occurring in the supply lines. The filter cap e.g. has a circumferential collar ensuring a high mechanical strength. The entrance slots in the filter consequently terminate upstream of the spherical segmental filter cap.

In a further development of the invention end boundary surfaces of the entrance slots located on the side of the jet director are rounded or inwardly inclined, the rounded end boundary surfaces having a convex construction towards the median longitudinal axis. The bottom of the entrance slots which, in the flow direction, is located on the side of the jet director is consequently outwardly curved or convexly constructed towards the median longitudinal axis. Alternatively the slot bottom is inclined inwards and is in particular conical shell section-like, the cone tapering in the flow direction. Thus, the flow through the entrance slots is gradually deflected towards the median longitudinal axis in the vicinity of the slot bottom. This significantly reduces turbulence in the vicinity of the slot bottom and there is a low flow resistance and a flow oriented substantially parallel to the median longitudinal axis downstream of the jet director.

In a further development of the invention the filter is formed by means of a filter cap and a main filter part, the filter cap and main filter part being manufactured as single components and then permanently interconnected.

This facilitates the manufacture even of geometrically complicated shapes in the vicinity of the filter cap and main filter part. Following the permanent connection of filter cap and main filter part a stable, flow-favourable filter unit is provided.

In a further development of the invention the filter cap and main filter part are manufactured by metal powder die casting and are then sintered together.

Metal powder die casting makes it possible to produce geometrically complicated shapes, which could not be produced by mechanical working or could only be produced when involving significant effort and expenditure. This e.g. includes the convex construction of the end faces of the filter entrance slots oriented towards the median longitudinal axis. Conventionally such entrance slots are constructed by immersing a milling cutter or saw blade in a tubular component. This generally leads to an outwardly directed, concave construction of the end faces, which is hydraulically unfavourable.

In a further development of the invention the main filter part is provided with the jet director.

This makes it possible to provide a low flow-resistance combined jet director and filter component. When manufacturing said combined jet director and filter component by means of metal powder die casting the inventive coreless jet director and a flow-favourable construction of the entrance slots on the filter can be implemented and manufactured serially. Alternatively the jet director can also be constructed as a separate flow channel component or can be integrated into a different nozzle component to the filter.

In a further development of the invention the filter cap has a circumferential collar with radially inwardly extending projections, which engage in matching recesses of the main filter part.

This makes it possible to implement a very stable connection of the filter cap to the main filter part, which also allows a very flow-favourable construction. Alternatively the main filter part can be provided with a circumferential collar with radially inwardly or outwardly extending projections, which then engage in matching recesses of the filter cap. Independently of whether the circumferential collar is provided with radially extending projections on the filter cap or the main filter part, the inventive advantages of a very stable, flow-favourable construction of the connection between filter cap and main filter part can be achieved.

In a further development of the invention the main filter part is provided on its end adjacent to the filter cap with webs extending parallel to the median longitudinal axis and between which the recesses are formed. Advantageously the entrance slots are formed between the main filter part webs.

Thus, the main filter part has circumferentially distributed quantities of fingers or webs extending in the upstream direction and between which the entrance slots are formed. The ends of said webs are received and fixed by the filter cap. Following the permanent connection of the main filter part and filter cap this leads to a stable component. With particular advantage the filter cap and main filter part can be manufactured by metal powder die casting and then sintered together.

The problem of the invention is also solved by a method for the manufacture of a spray nozzle, particularly a high pressure nozzle for descaling steel products, in which the following steps are provided:

mixing metal powder with plastic binder, die casting the resulting mixture in a mould, removing the binder by chemical and/or thermal processes and sintering the intermediate product obtained after removing the binder.

Such a metal powder die casting method also makes it possible to achieve very complicated geometrical shapes, which cannot be manufactured or can only be manufactured with considerable effort and expenditure by conventional mechanical working. The use of die casting machines makes it possible to bring about comparatively inexpensive manufacture in series production quantities, which reduces costs, e.g. compared with precision casting. It has surprisingly been found that components obtained by metal powder die casting are sufficiently stable to withstand the significant operating pressures of several hundred bar occurring with high pressure nozzles for descaling steel products. Over and above the high operating pressures, in pipelines for supplying descaling nozzles pressure surges can occur which are a multiple of the operating pressures. Metal powder die casting leads to sintered components and it is initially to be expected that the sintered components would have a brittle character and would therefore be unsuitable for loads with extreme pressure peaks, such as occur when operating descaling nozzles. However, tests have surprisingly shown that the sintered parts obtained by metal powder die casting and in the case of a corresponding design are able to withstand these loads and stresses and also offer new possibilities for the flow optimization of high pressure nozzles.

According to a further development of the invention the individual components in the form of intermediate products are assembled following binder removal and then the assembled intermediate products are sintered.

As a result components can be manufactured integrally, e.g. in the form of a combined jet director and filter component including the filter cap, because following sintering the assembled intermediate products are permanently interconnected. This offers further possibilities for a simultaneously stable and flow-favourable design of high pressure nozzles. Following binder removal the intermediate product has a comparatively fragile structure, because following binder removal the metal powder has a porous structure. Only during sintering is the intermediate product compacted and is then mechanically highly loadable.

In a further development of the invention the metal powder at least partly contains hard metal powder.

It has surprisingly been found that even hard metal/carbide parts can be manufactured by metal powder die casting. This is particularly advantageous for the manufacture of mouthpieces of high pressure descaling nozzles. Also in the mouthpiece area and specifically in the area of the discharge chamber and discharge opening this makes it possible to bring about complicated geometrical shapes, which cannot or cannot be produced with acceptable costs by mechanical working. Following sintering of the hard metal powder intermediate product a hard metal component is obtained, which is eminently suitable for use as a high pressure descaling nozzle mouthpiece and in particular has a long service life.

In a further development of the invention the high pressure nozzle has at least one filter and a jet director in a combined filter and jet director component, which is assembled from at least two individual parts, which are permanently interconnected by sintering.

BRIEF DESCRIPTION OF THE DRAWINGS

Further features and advantages of the invention can be gathered from the claims and the following description of a preferred embodiment of the invention, as well as the attached drawings, in which:

DETAILED DESCRIPTION

Figure 1:
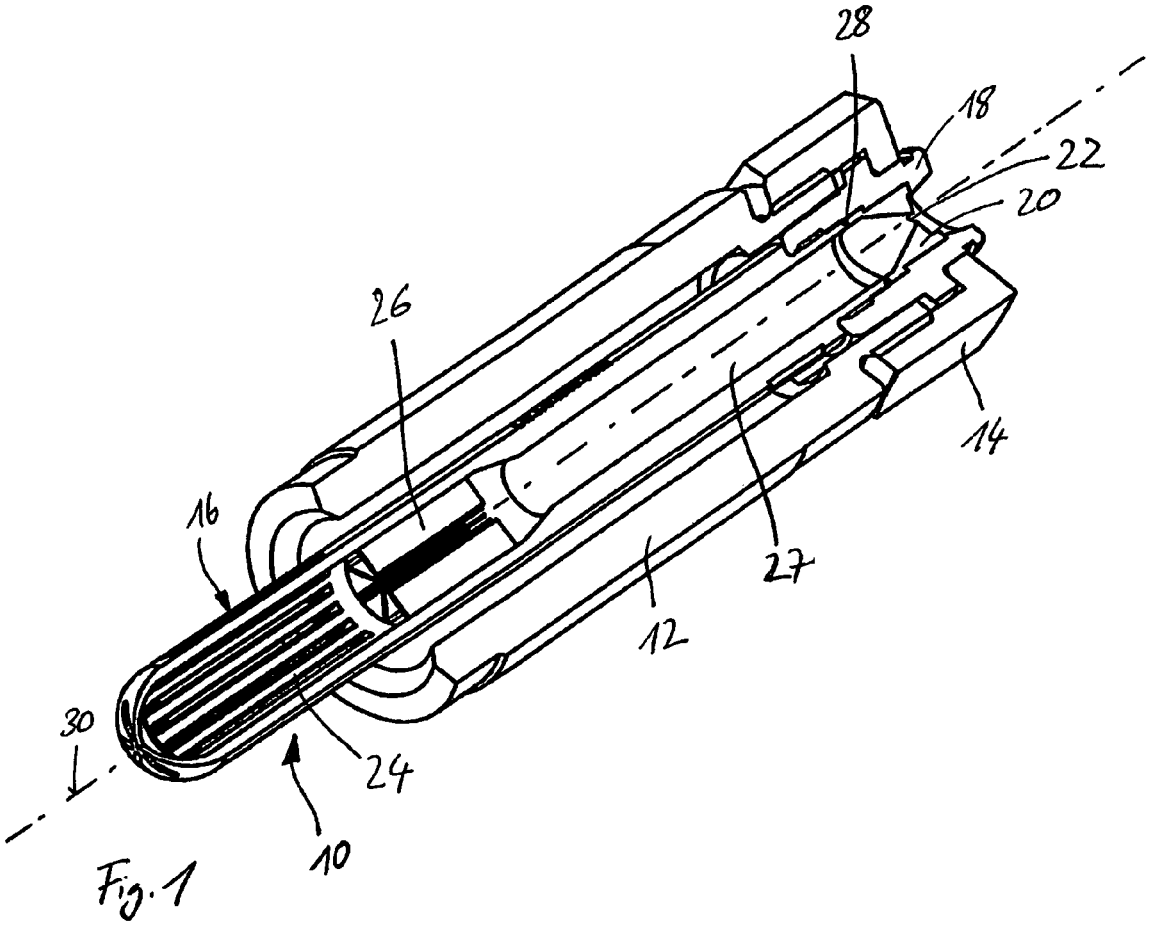
FIG. 1 is a perspective, cut-open view of an inventive high pressure nozzle.

The perspective sectional view of FIG. 1 shows an inventive high pressure nozzle 10 for descaling steel products. The high pressure nozzle 10 is installed in a tubular connection nipple 12 and is secured in the latter by means of a box nut 14. The high pressure nozzle 10 has a combined filter and jet director component 16 screwed into a nozzle housing 18. Into nozzle housing 18 is inserted a mouthpiece 20, which at its downstream end defines a discharge opening 22. The tubular connection nipple 12 is connected to a not shown nozzle beam into which projects a filter 24 of high pressure nozzle 10. Liquid entering the high pressure nozzle 10 through filter 24 flows via a jet director 26 and ultimately reaches the mouthpiece 20, passing out of the discharge opening 22 in the form of a flat jet or spray. Mouthpiece 20 is sealed against nozzle housing 18 by means of a circumferential soldered metal joint 28.

FIG. 1 clearly shows that the jet director 26 leaves free a flow channel directly surrounding a median longitudinal axis 30 of high pressure nozzle 10. Thus, in the vicinity of jet director 26 there is a flow channel, without any built-in fittings, directly surrounding median longitudinal axis 30. The jet director 26 has several flow guidance surfaces extending radially towards the median longitudinal axis 30 and which have a planar construction and are oriented parallel to median longitudinal axis 30. By means of jet director 26 the liquid entering filter 24 can be oriented parallel to the median longitudinal axis 30. As will be explained hereinafter and as can be seen in FIG. 1, the several flow guidance surfaces of jet director 26 are only fixed to the outer circumference of the jet director and project freely in the direction of the flow channel surrounding median longitudinal axis 30.

Figure 2:
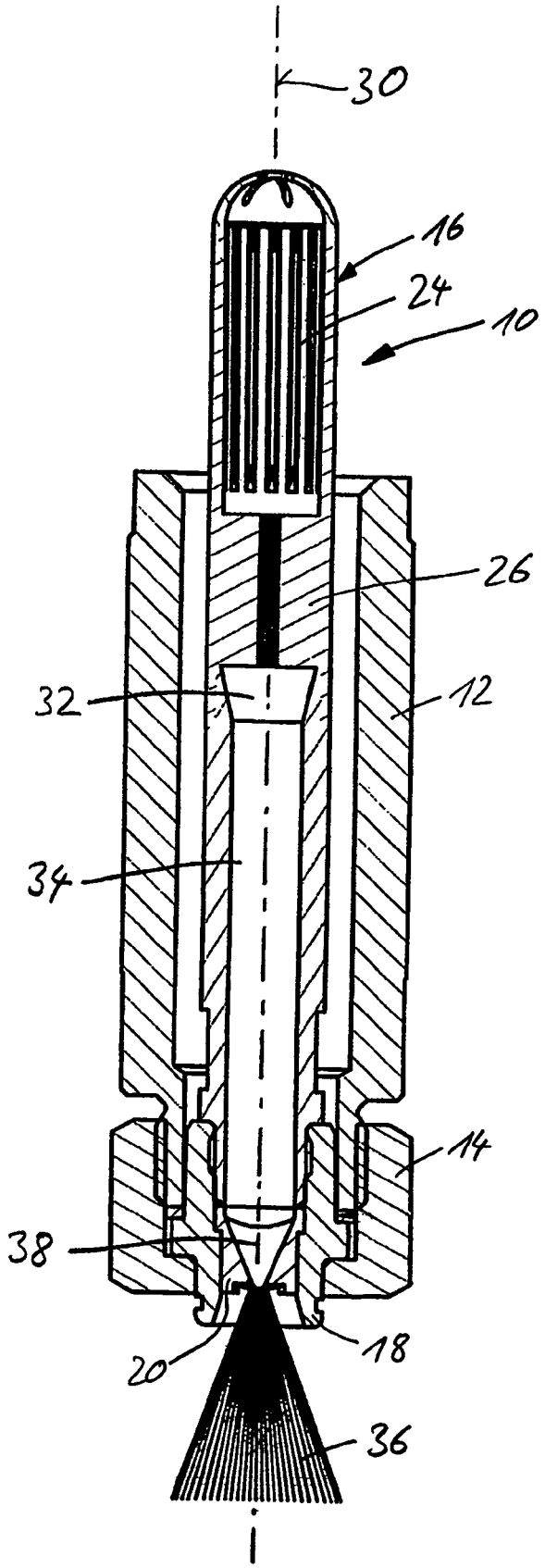
FIG. 2 is a sectional view of the high pressure nozzle of FIG. 1.

The sectional view of FIG. 2 shows two facing flow guidance surfaces of jet director 26 through which passes the sectional plane. Upstream of jet director 26 is located filter 24, which is formed from a circular cylindrical tubular portion with entrance slots extending radially to the median longitudinal axis 30 and which is provided with a spherical segmental filter cap.

Downstream of jet director 26 is connected a conically tapering portion 32, which passes into a circular cylindrical portion 34 with constant diameter. The tapering portion 32 is shorter than jet director 26 and has approximately ⅓ to ½ of the length of said jet director 26. The constant cross-section portion 34 downstream of the tapering portion 32 is much longer than jet director 26 and also much longer than the tapering portion 32. In the embodiment shown the constant cross-section portion 34 is roughly three times as long as the jet director 26 and roughly seven times as long as the tapering portion 32. It has been found that such length dimensions of jet director 26, taper 32 and constant cross-section portion 34 makes it possible to set flow conditions favouring a precise shaping of an emerging flat jet 36. Downstream of the constant diameter portion 34 is connected a discharge chamber 38 in mouthpiece 20. The discharge chamber 38 tapers conically and ends at the discharge opening. The length of discharge chamber 38 is roughly half that of the jet director 26 and is much less than the length of the constant cross-section portion 34. The length of discharge chamber 38 is roughly of the order of magnitude of taper 32 directly downstream of jet director 26.

In the case of the inventive high pressure nozzle a free flow channel is made available for the flow and is tapered in two stages over a relatively short path, namely on the one hand by the tapering portion 32 directly downstream of the jet director 26 and then, once again over a comparatively short path, by the tapering discharge chamber 38. It has been found that such a two-stage tapering, in each case relatively pronounced constriction of the flow channel over a short path is hydraulically more favourable than a very gradual taper or narrowing over a long path. In particular, the available free cross-section by means of portion 32 over a short path is relatively markedly constricted and along the constant cross-section, long portion 34 the flow can calm again in order to enter very uniformly the discharge chamber 38.

The maximum free flow cross-section occurs in the vicinity of filter 24 and is defined by the sum of the free cross-sections of the elongated filter slots and the further filter slots in the filter cap. An already significantly reduced flow cross-section is present in the vicinity of the jet director 26, the flow cross-section there resulting from the overall channel cross-section, less the end faces of the radially positioned flow guidance surfaces. The ratio of the free flow cross-sectional surface at jet director 26 to the free flow cross-sectional surface of filter 24 is advantageously 1:6 or higher.

A further reduction of the flow cross-section takes place downstream of the jet director 26 on the cross-section of channel 27, which passes with a constant cross-section to upstream of mouthpiece 12. The ratio of the free flow cross-sectional surface in channel 27 to the free flow cross-sectional surface at jet director 26 is advantageously 1:1.23 or higher.

The ratio of the free flow cross-sectional surface in channel 27 to the free flow cross-sectional surface of filter 24 is advantageously 1:7.44 or higher.

The free flow cross-sectional surface in channel 27 is e.g. 95 $mm^2$ the free flow cross-sectional surface in jet director 26 is e.g. 117 $mm^2$ and the free flow cross-sectional surface at filter 24 is e.g. 707 $mm^2$.

A soldered metal joint 28 sealing mouthpiece 12 against nozzle housing 14 is provided at the upstream end of mouthpiece 12 between an inner wall of nozzle housing 14 and an annular end face of mouthpiece 12.

Figure 3:
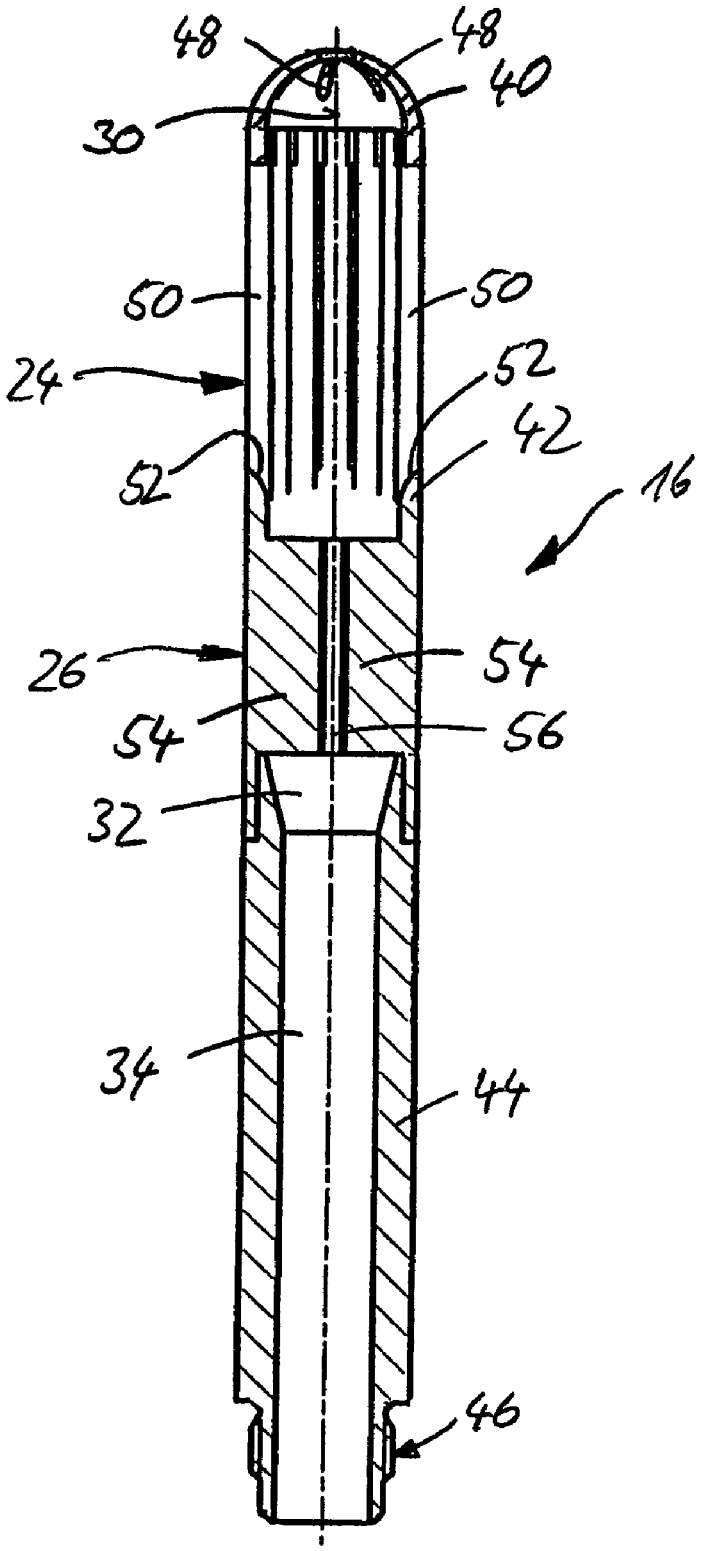
FIG. 3 is a sectional view of a combined jet director and filter component of the high pressure nozzle of FIG. 1.

The sectional view of FIG. 3 shows the combined jet director and filter component 16 of high pressure nozzle 10 of FIG. 1. Component 16 comprises three individual parts, which are permanently interconnected, namely a filter cap 40, a main filter part 42, which also has the jet director 26, and a line part 44, which is provided with the tapering portion 32 downstream of jet director 26 and the constant cross-section portion 34. At its downstream end line part 44 is provided with an external thread 46 with which the line part 44 is screwed into the nozzle housing 18.

Filter cap 40 is spherical segmental and has entrance openings 48 extending parallel to median longitudinal axis 30. The entrance openings 48 are arranged radially on filter cap 40. The main filter part 42 has several webs 50 extending parallel to median longitudinal axis 30 and which are arranged around its circumference in uniformly spaced manner. Between the webs 50 are located entrance slots through which the liquid can enter filter 24.

FIG. 3 clearly shows that the downstream end faces 52 of the entrance slots are rounded and are convexly curved towards the median longitudinal axis 30. Liquid entering the entrance slots is consequently gradually deflected towards the median longitudinal axis 30 in the vicinity of the downstream end faces of the entrance slots. This keeps low the turbulence in the vicinity of end faces 52 and leads to a low flow resistance and uniform flow.

FIG. 3 also clearly shows that the planar flow guidance surfaces 54 of jet director 26 extending radially towards the median longitudinal axis 30 leave free a flow channel 56 without built-in fittings directly surrounding said median longitudinal axis.

The filter cap 40, main filter part 42 with jet director 26 and line part 44 are manufactured as individual parts by metal powder die casting and then, after removing a thermoplastic binder, are assembled as individual intermediate products and then sintered. Following sintering filter cap 40, main filter part 42 and line part 44 are permanently interconnected and form the highly loadable, combined jet director and filter component 16. Manufacture by metal powder die casting will be described in detail hereinafter.

Figure 4:
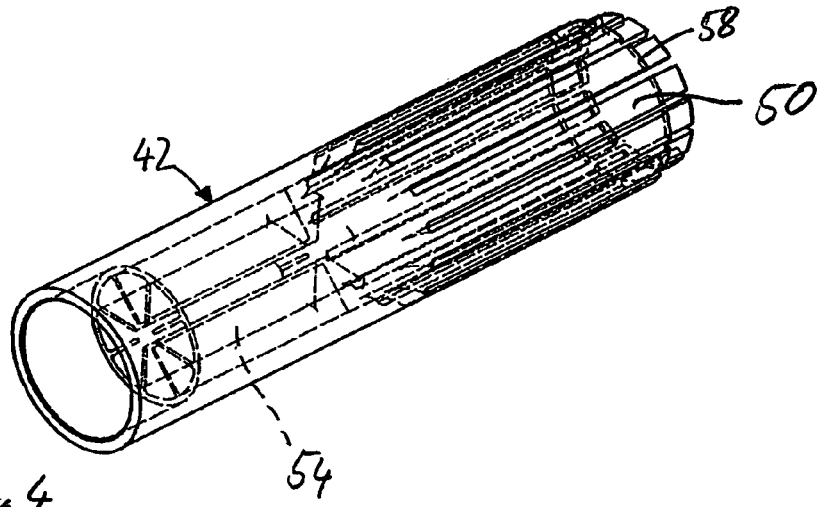
FIG. 4 is a perspective view of a main filter part with integrated jet director of the component of FIG. 3.

FIG. 4 perspectively shows the main filter part 42 of FIG. 3. In broken line form are shown the not visible details, such as the radially oriented flow guidance surfaces 54 and concealed entrance slots between webs 50. At the upstream end the webs 50 are constructed with a reduced thickness, so that each web 50 has a step 58, which serves as a stop member on engaging filter cap 40, as can be seen in the side view of FIG. 5.

Figure 5:
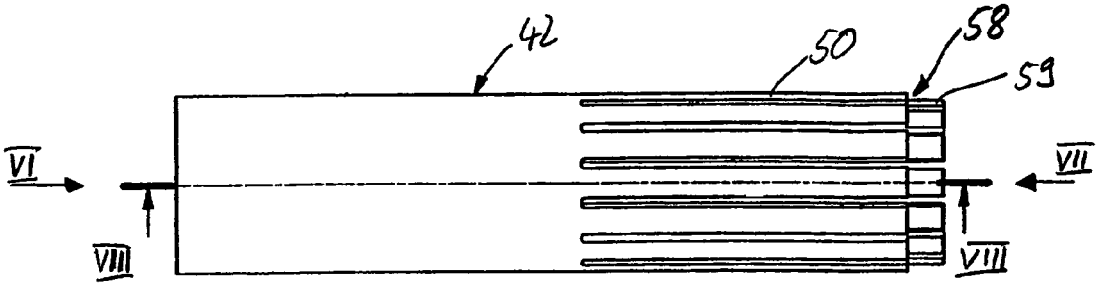
FIG. 5 is a side view of the main filter part of FIG. 4.
Figure 6:
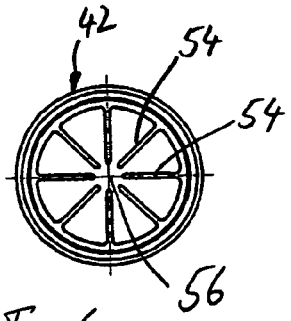
FIG. 6 is a view of the main filter part of FIG. 5 in the direction of arrow VI.

The view of FIG. 6 in the direction of arrow VI of FIG. 5 shows the jet director flow guidance surfaces 54 extending towards the median longitudinal axis 30 and which leave free around the latter said flow channel 56. As has already been explained, only the radially outer end of the flow guidance surfaces 54 is connected to the inner wall of the main filter part 42 and project freely towards the median longitudinal axis. FIG. 6 makes it clear that the flow guidance surfaces 54 leave free a comparatively equally large cross-section and despite a very good straightening effect only give rise to a limited flow resistance. All the edges of the flow guidance surfaces 54 projecting into the flow are rounded.

Figure 7:
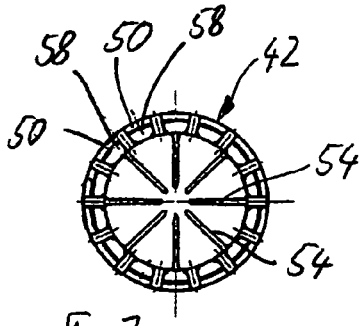
FIG. 7 is a view of the main filter part of FIG. 5 along arrow VII.

FIG. 7 is a view of the main filter part 42 in the direction of arrow VII in FIG. 5. It is clearly possible to see the free ends of webs 50 with in each case a step 58. Webs 50 leave between them entrance slots extending radially towards the median longitudinal axis and through which liquid can enter the interior of the main filter part 42. The number of slots between the webs 5 exceeds the number of flow guidance surfaces. In the embodiment shown there are eight flow guidance surfaces 54 and fourteen entrance slots, which are in each case uniformly distributed around the circumference of the main filter part 42.

Figure 8:
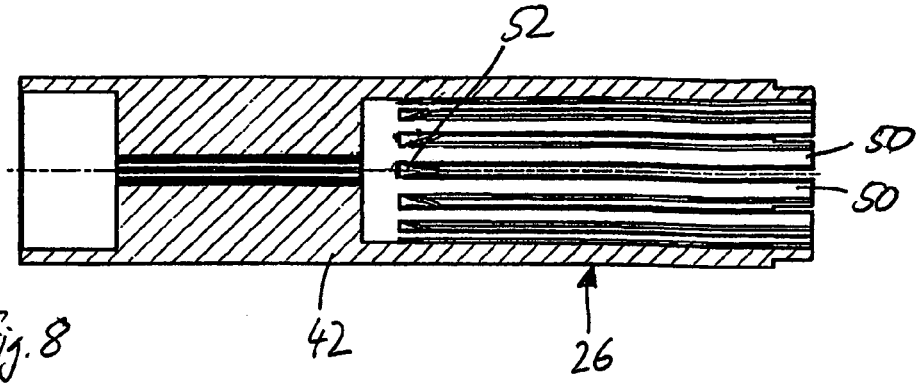
FIG. 8 is a view of the main filter part of FIG. 5 relative to sectional plane VIII-VIII.

The sectional view of the main filter part 42 in FIG. 8 on the sectional plane VIII-VIII of FIG. 5 reveals the rounded construction of the end faces 52 of the entrance slots between the webs 50 of filter 24.

Figure 9:
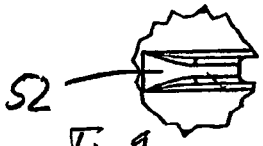
FIG. 9 is a larger scale view of a detail of the main filter part of FIG. 8.
Figure 10:
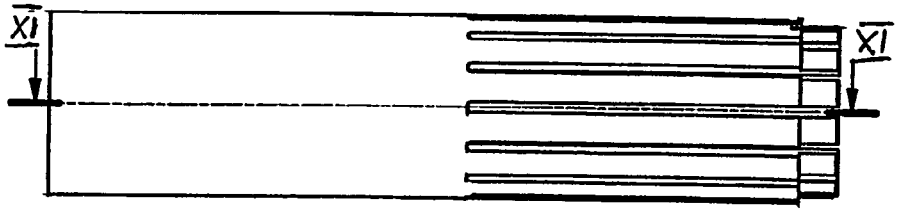
FIG. 10 is another side view of the main filter part of FIG. 4.
Figure 11:
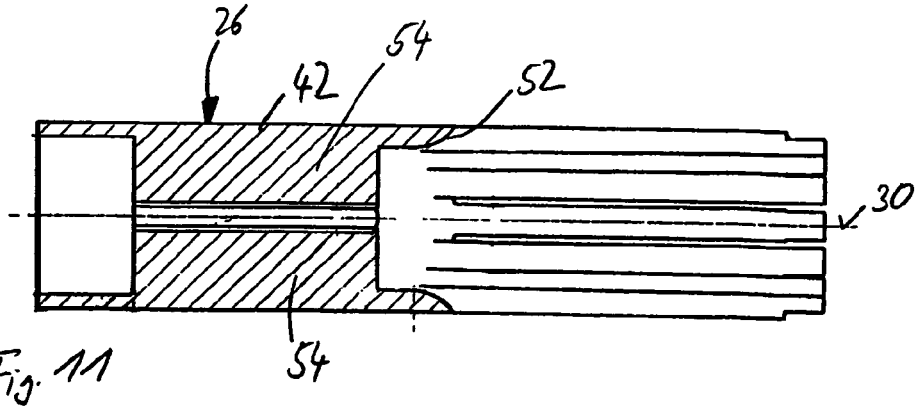
FIG. 11 is a sectional view of the main filter part of FIG. 10 relative to sectional plane XI-XI.

The end faces 52 of the entrance slots are curved, as is particularly apparent from the sectional view of FIG. 11 on sectional plane XI-XI of 10, showing a convex construction in the direction of the median longitudinal axis 30. Moreover the transitions between end faces 52 and the lateral boundaries of webs 50 defining the entrance slots are rounded, as is particularly clear in FIG. 9. The liquid entering through the entrance slots is deflected towards the median longitudinal axis 30 accompanied by limited turbulence and therefore low flow losses. The free edges of the flow guidance surfaces 54 of jet director 26 are also rounded, as can be seen in FIGS. 6, 7 and 11.

Figure 12:
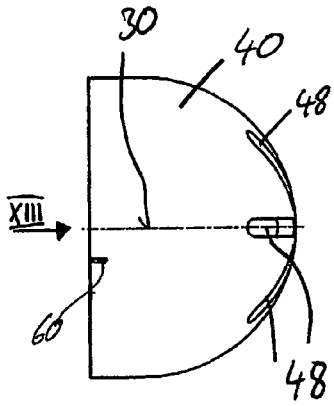
FIG. 12 is a side view of a filter cap of the component of FIG. 3.

FIG. 12 is a side view of filter cap 40, which is constructed in essentially spherical segmental form and has radial entrance openings 48 around median longitudinal axis 30 and extending parallel to the latter. Through said entrance openings 48 liquid can enter the interior of the filter and on entry is already oriented parallel to the median longitudinal axis 30. Filter cap 40 has an indexing slot 60, which facilitates the angularly correct mounting of filter cap 40 on main filter part 42.

Figure 13:
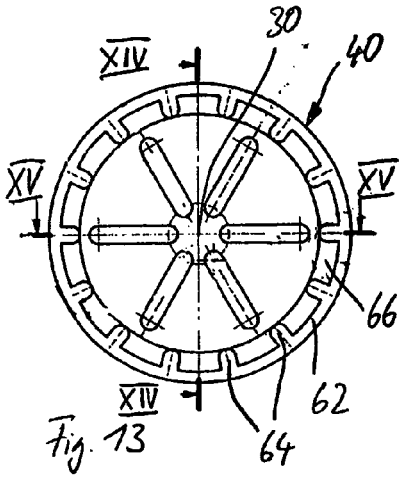
FIG. 13 is a view of the filter cap of FIG. 12 in the direction of arrow XIII.

FIG. 13 is a view of filter cap 40 along arrow XIII in FIG. 12. It can be seen that the filter cap 40 has a circumferential collar 62 with several projections 64 extending radially towards the median longitudinal axis 30. Between each of the projections 64 is formed recesses 66 for receiving the free ends of webs 50 of main filter part 42. The thickness of webs 50 corresponds to the wall thickness of filter cap 40 and therefore the radial dimension of projections 64, plus the thickness of collar 62, i.e. the length from the outer wall of filter cap 40 to the inner wall in the vicinity of a projection 64. As was already explained relative to FIG. 5, the thickness of the free ends of webs 50 is reduced. Thus, on mounting the filter cap the free ends 59 engage in recesses 66 and the free ends 59 are in this way matched to the dimensions of recesses 66, so that an inner wall of the webs 50 in the engaged state of cap 40 is aligned with the inner wall of cap 40. Filter cap 40 is engaged to such an extent that the circumferential collar 62 engages with its lower edge on shoulder 58 of the main filter part 42. As the material thickness of webs 50 corresponds to the wall thickness of filter cap 40, following the mounting of filter cap 40 on main filter part 42 both the outer wall of webs 50 and the outer wall of filter cap 40, as well as the inner wall of webs 50 and the inner wall of filter cap 40 are oriented in an aligned manner to one another. This can be gathered from the sectional view of FIG. 3 of the assembled, combined jet director and filter component 16. Thus, in the assembled state of filter cap 40 and main filter part 42 there are only very narrow gaps between filter cap 40 and main filter part 42.

Advantageously both filter cap 40 and the main filter part 42 are manufactured by metal powder die casting and are sintered in the assembled state following binder removal. As a result of sintering the filter cap 40 and main filter part 42 are permanently connected and the narrow gaps still present after assembly are filled, so that after filtering there is an integral, substantially gapless component.

Figure 14:
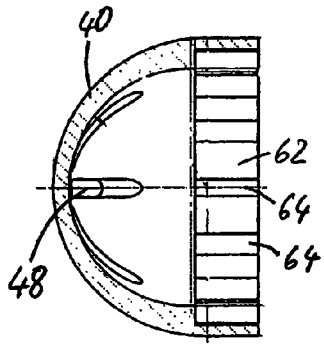
FIG. 14 is a sectional view on sectional plane XIV-XIV of FIG. 13.
Figure 15:
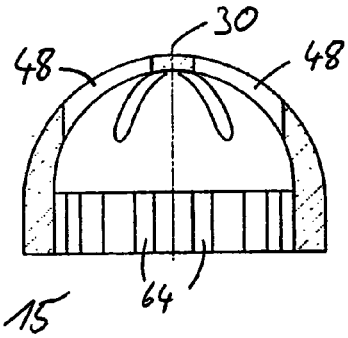
FIG. 15 is a sectional view on sectional plane XV-XV of FIG. 13.

FIG. 14 is a sectional view on sectional plane XIV-XIV of FIG. 13 and FIG. 15 is a sectional view on sectional plane XV-XV of FIG. 13. FIGS. 14 and 15 show that the wall thickness of filter cap 40 as from collar 62 gradually decreases from its apex, i.e. the intersection of median longitudinal axis with the wall of filter cap 40. As a result of such a construction the length of the entrance slots 48 parallel to median longitudinal axis 30 can be kept as short as possible, which is advantageous for a low flow resistance and at the same time filter cap 40 can be made extremely stable, so that it also withstands severe pressure surges during the operation of the inventive high pressure nozzle.

Figure 16:
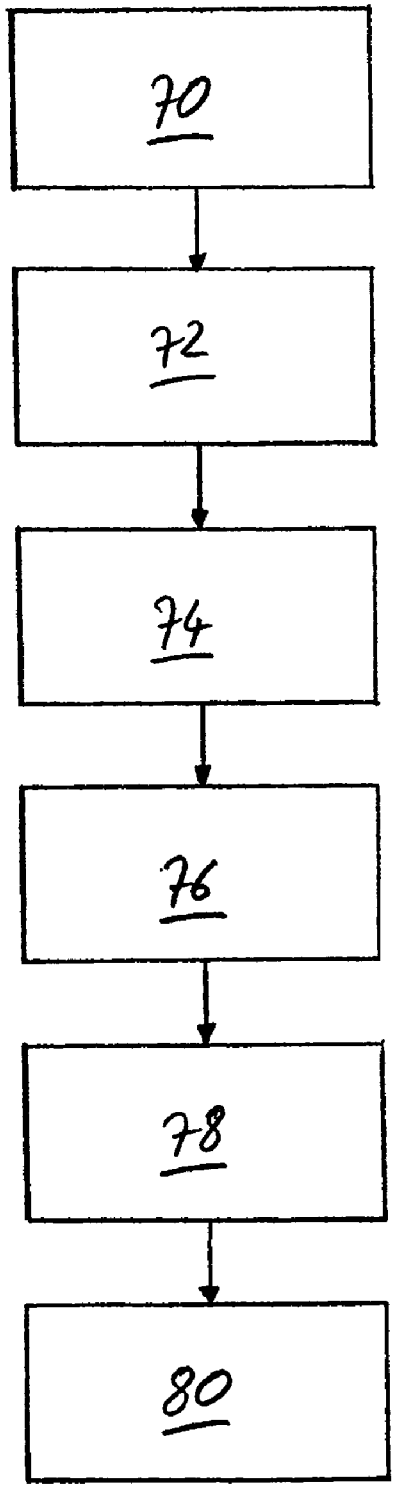
FIG. 16 is a diagrammatic representation for illustrating the method of the invention.

The diagrammatic view of FIG. 16 illustrates the inventive method for the manufacture of a high pressure nozzle by metal powder die casting.

In a first method step 70 metal powder is mixed with a thermoplastic binder. The metal powder can e.g. be a hard metal powder. The resulting mixture is also referred to as feedstock.

In a second step 72 the thus obtained mixture is brought into a die casting mould. Conventional die casting machines are used, because as a result of the thermoplastic binder the mixture has plastic-like properties and is suitable for die casting. The intermediate product obtained after die casting is referred to as the green component.

The following step 74 involves binder removal and during step 74 the thermoplastic binder is removed from the intermediate product using suitable processes. They can e.g. be thermal or chemical processes. Following binder removal an intermediate product results which has a comparatively porous structure, in which there are gaps between the individual metal powder particles which were originally filled by the thermoplastic binder. The intermediate product obtained after binder removal is also referred to as a brown component.

Following binder removal individual parts can be assembled in a step 76. As described, filter cap 40, main filter part 42 and jet director 26 and line part 44 are separately manufactured by metal powder die casting and are assembled following binder removal. The line part 44 can also be manufactured as a standard lathe work and then assembled with the binder-removed intermediate products, namely filter cap 40 and main filter part 42.

In the assembled state of the intermediate products they are sintered in a step 78. Sintering takes place by a heat treatment process. After sintering the material characteristics of the resulting end product are comparable with those of solid materials. The assembled individual parts, specifically filter cap 40, main filter part 42 and feedline part 44 are permanently interconnected by the sintering step 78 and any gaps present between said individual parts disappear. The outer and inner walls of the combined jet director and filter component 16 run in smooth-surfaced manner without any noticeable gaps, which is advantageous for a low flow resistance.

In a final step 80 the sintered together components, i.e. the combined jet director and filter component 16, can undergo reworking or surface-treatment. Thus, the accessible surfaces can e.g. be line polished in order to reduce the flow resistance.

The combined jet director and filter component manufactured by metal powder die casting can have a flow-favourable and at the same time high strength construction. The use of metal powder die casting consequently gives rise to surprising improvements compared with conventional high pressure nozzles.

The invention claimed is:

1. High pressure nozzle for descaling steel products, the high pressure nozzle including a jet director within a supply channel leading to a discharge opening, the jet director having a free flow cross-section in an area directly surrounding a central longitudinal axis of the supply channel, the high pressure nozzle further including a supply channel taper disposed downstream of the jet director, and a filter formed by a filter cap and a main filter part, the main filter part defining entrance slots therein downstream of the filter cap and upstream of the jet director, the entrance slots being oriented radially to the central longitudinal axis and extending parallel to the central longitudinal axis, the filter cap and the main filter part being manufactured as individual parts and then permanently interconnected to one another.

2. High pressure nozzle according to claim 1, wherein the jet director has flow guidance surfaces extending parallel to and towards the central longitudinal axis.

3. High pressure nozzle according to claim 2, wherein the flow guidance surfaces extend radially towards the central longitudinal axis.

4. High pressure nozzle according to claim 1, wherein the jet director is constructed integrally with the main filter part.

5. High pressure nozzle according to claim 1, wherein, downstream of the jet director, a portion having a channel of a constant cross-section passing into a tapering discharge chamber is connected onto and is in communication with the taper.

6. High pressure nozzle according to claim 1, wherein the filter cap is spherically-shaped and is provided with entrance openings extending parallel to the central longitudinal axis.

7. High pressure nozzle according to claim 1, wherein end faces of the entrance slots located adjacent the jet director are rounded or inclined inwardly towards the central longitudinal axis, the end faces being convexly constructed in the direction of the central longitudinal axis such that the end faces have respective convex parts which face towards the central longitudinal axis.

8. High pressure nozzle according to claim 1, wherein the filter cap and the main filter part are manufactured by metal powder die casting and are then sintered together.

9. High pressure nozzle according to claim 8, wherein the main filter part comprises the jet director downstream of the entrance slots.

10. High pressure nozzle according to claim 1, wherein one of the filter cap and the main filter part has a circumferential collar with radially extending projections which engage in matching recesses of the other one of the main filter part and the filter cap.

11. High pressure nozzle according to claim 1, wherein the filter cap has a circumferential collar with radially inwardly extending projections which engage in matching recesses of the main filter part.

12. High pressure nozzle according to claim 11, wherein at an end of the main filter part adjacent to the filter cap, webs extend parallel to the central longitudinal axis and between which the recesses are formed.

13. High pressure nozzle according to claim 12, wherein the entrance slots are formed between the webs of the main filter part and are coextensive with the respective recesses.

14. A high pressure nozzle for descaling steel products for installation in and communication with a liquid supply channel defining a central longitudinal axis and having an upstream end wherein liquid enters the supply channel and a downstream end where liquid is discharged from the supply channel, said nozzle comprising a jet director defining at least one guide surface disposed to guide flow of liquid through said nozzle and a central area disposed radially inwardly of said guide surface and coextensive with the central longitudinal axis of the supply channel, said central area being unobstructed to permit the flow of liquid through said central area such that liquid flows through said jet director along said guide surface and through said central area from the upstream end to the downstream end of the supply channel, said nozzle further including a cylindrical portion disposed downstream of said jet director and defining a channel therein, a first part of said channel disposed immediately adjacent and downstream of said jet director being tapered to restrict the flow of liquid as same flows in an upstream to downstream direction through said first part, said channel including a second part disposed downstream of said first part, said second part having a constant diameter along an entire longitudinal extent of said second part which is substantially equal to a diameter of a downstream end of said first part.

15. The nozzle of claim 14, wherein said jet director has a tubular shape defined by an outer tubular wall, and includes a plurality of guidance members extending axially along said jet director, each said guidance member having an outer end fixed to said tubular wall and projecting radially inwardly towards the central longitudinal axis and terminating at an inner free end, each said guidance member defining thereon a said guide surface, and said inner free ends of said guidance members each terminating radially outwardly of the central longitudinal axis to define said central area.

* * * * *